United States Patent [19]

Larson

[11] 4,296,821

[45] Oct. 27, 1981

[54] DRILLING RIG AND CONVERSION APPARATUS

[76] Inventor: Leslie Larson, P.O. Box 334, Mabel, Minn. 55954

[21] Appl. No.: 119,461

[22] Filed: Feb. 7, 1980

[51] Int. Cl.[3] ..... E21B 4/06; E21B 6/00; E21B 7/20

[52] U.S. Cl. ..... 175/87; 173/29; 173/104; 173/147; 175/103; 175/171

[58] Field of Search ..... 175/171, 103, 189, 195, 175/87; 173/133, 128, 73, 78, 80, 29, 104, 147

[56] References Cited

U.S. PATENT DOCUMENTS

| | | | |
|---|---|---|---|
| 2,684,229 | 7/1954 | Bergstrom | 175/171 X |
| 2,950,087 | 8/1960 | Gregory | 175/103 |
| 3,390,730 | 7/1968 | Techy et al. | 175/171 |
| 3,474,870 | 10/1969 | Cook | 173/91 |
| 3,645,343 | 2/1972 | Mays | 175/171 X |
| 3,682,260 | 8/1972 | Klemm | 175/257 X |
| 3,703,212 | 11/1972 | Abrahams | 175/171 X |
| 3,833,072 | 9/1974 | Back | 175/171 X |
| 3,835,943 | 9/1974 | Bray | 175/135 |

OTHER PUBLICATIONS

TRW Mission, *Operation and Maintenance Manual No. 105,* Percussion Drilling Equipment, TRW Mission Manuf. Co., Houston, Texas, pp. 1-26, Dec. 1975.

Mission Manufacturing Co., Catalog N. 461, "Mission Megadril", 4 pp., Mar. 1971.

Ingersoll-Rand Brochure, "New DHD 16 Downhole Drill", Phillipsburg, N.J., 2 pp., 1969.

Hughes Tool Company, Catalog, "Rota-Blast Tri--Cone Rock Bits and Ram Blast Percussion Bits", Dallas, Texas, 16 pp., Mar., 1967.

Kennametal Inc. Brochure, "Kenroc Down-Hole Bits", Kennametal Inc., Mining Tool Group, Bedford, Pa., 4 pp.

Kennametal Inc. Brochure, "Kenclaw 43", Kennametal Inc., Mining Tool Group, Bedford, Pa., 4 pp.

Wellen Drill Tools, Inc., Bulletin, "The Drillthru Casing Hammer," Enumclaw, WA., 8 pp.

*Primary Examiner*—Stephen J. Novosad

*Attorney, Agent, or Firm*—Merchant, Gould, Smith, Edell, Welter & Schmidt

[57] ABSTRACT

An improved drilling rig (10) and conversion apparatus for drilling rigs is disclosed. The rig includes a percussion assembly (32) rotatably mounted to a ram (30) above the ground in which drilling is to be made. The rig (10) includes a conversion mandrel (40) structured for insection in, and retention by, the percussion assembly (32) in place of a normally retained bit element (34). The mandrel (40) has an anvil surface (56) to which percussive strokes of a piston (50) disposed within the percussion assembly (32) for reciprocating movement therein are applied. The mandrel (40) further includes a hammer portion (68) to transfer both the percussive force of the piston (50) and continuous downward pressure applied to the percussion assembly (32) by the ram 30 to a length of casing (20) encircling the drill rod (22) which accomplishes the drilling. The conversion apparatus can, therefore, convert a bottom-hole drilling rig to a top-of-the-hole rig.

13 Claims, 9 Drawing Figures

FIG.1
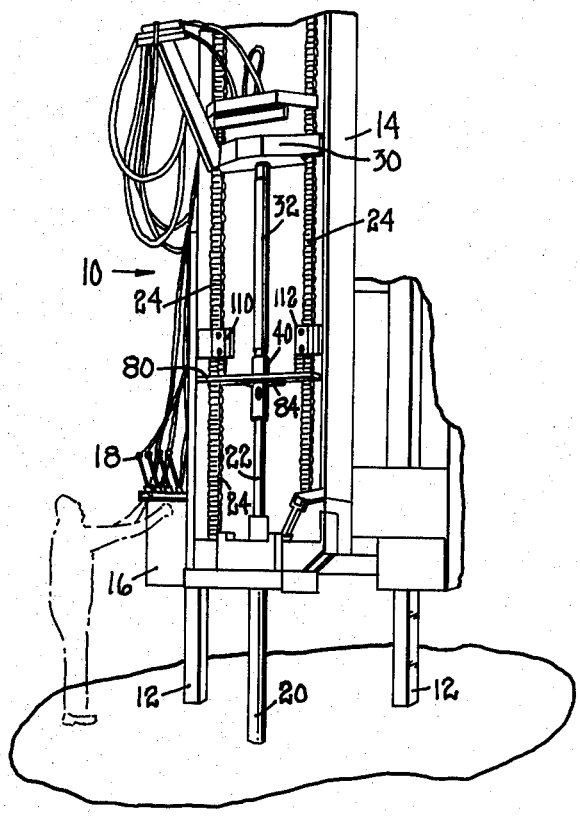
FIG. 5
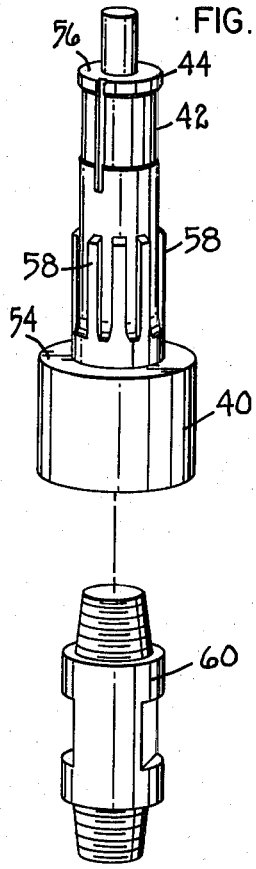
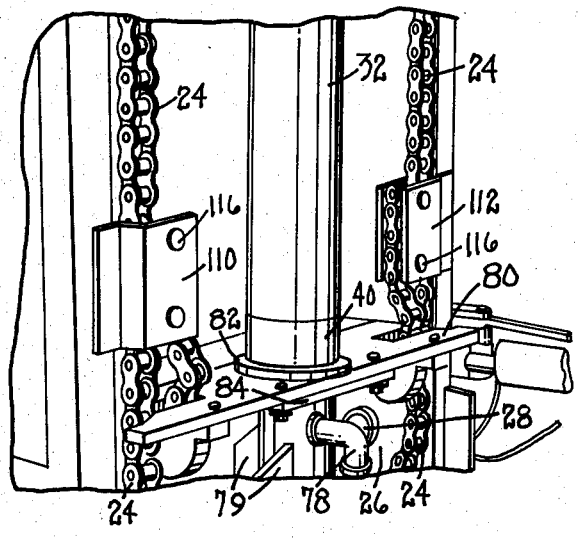
FIG.2
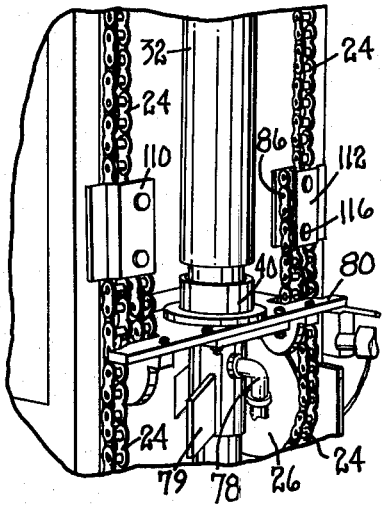
FIG.3

DRILLING RIG AND CONVERSION APPARATUS

TECHNICAL FIELD

The invention of this application relates generally to the field of construction and mining drilling. More specifically, it relates to apparatus for adapting bottom-hole drilling rigs as used in well drilling to top-of-the-hole rigs which can simultaneously accomplish hole drilling and casing driving.

BACKGROUND OF THE PRIOR ART

The most basic type of drilling rig includes a joint or string of joints of drill rod having a bit mounted at the bottom end thereof. The drilling rod is mounted to a ram which applies down pressure to the drill rod string as it rotates to effect the drilling function. As one joint of drill rod becomes completely submerged beneath the level of the ground, an additional joint can be attached to the upper end of the previous joint and fixedly attached to the ram to complete the rig.

A more sophisticated type of rig is characterized as a percussion rig. In such a rig, an assembly which can include a rotatable bit extends downwardly into the hole being dug, by one or a series of connected drill rod joints. The assembly further includes a percussion piston which is caused to impact upon an upper end of the drill bit element. In most rigs of this type, the bit element includes an annular lip which axially engages a retaining ring detachably mounted within the assembly to maintain the bit suspended from the assembly. The cooperation of the structure of the bit element and the rest of the assembly is such that the bit may slide within the assembly axially with respect to the hole being drilled.

The percussion piston is pneumatically activated typically by high pressure air which is made to flow from the rig downward through the joints of drill rod. This activation is effected when the bit element is engaging the bottom of the hole and the constant down pressure of the ram is being applied to the percussion assembly. The annular lip formed in the bit element is, thereby forced to withdraw axially upward away from the retaining ring. With the bit element in this relationship with respect to the rest of the percussion assembly, the activation fluid is directed to cause impacting of the percussion piston upon the upper end of the drill bit element.

In rigs of this type, both rotational motion and vibratory motion parallel to the direction of the drilled hole can be imparted to the bit simultaneously. Such a rig is particularly useful when the ground through which the hole must be drilled is unusually hard or rocky.

The pneumatic fluid which can be used to activate the percussion piston can also serve an additional function. The downward pressure applied by the ram can be abated and the string of drill rod withdrawn from the hole slightly so that the annular lip formed in the bit element engages the retaining ring with the bit element, thereby, suspended from the ring. With the bit element so disposed with respect to the rest of the percussion assembly, the HP air can be made to exit through ports formed in the bit proximate the interface between the cutting surface of the bit and the ground. The fluid can thus serve to entrain loose drilled matter, or cuttings, within an air flow created upwardly within the hole and blow these cuttings out of the hole.

In certain circumstances, percussion drilling is used in ground composed of soft material which can fall from the sides of the drilled hole as the drill rod is withdrawn therefrom. The hole can, therefore, become filled with loose materials so that the effect of the drilling is, to some degree, negated. These problems can be overcome by simultaneously inserting a casing within the hole around the drill string to support the inner surface of the hole. With the casing serving as an inner retaining wall, when the drill rod and bit assembly are withdrawn, cuttings will not fill the hole.

When drilling and casing insertion functions are effected simultaneously, since the inside diameter of the case must, necessarily, be larger than the outside diameter of the bit in order that the bit can be withdrawn, pressure must be applied to the casing at its end external to the hole in order to drive it down around the drill rod. There are structures currently in use today which can simultaneously accomplish the drilling and casing driving functions. In such devices, however, separate assemblies are used to effect each of the functions. Consequently, such devices tend to be bulkier than more conventional drilling rigs.

Additionally, these dual function devices have tended to make the older, more conventional rigs obsolete in a sense, at least as applicable to dual function drilling. Drilling companies have, therefore, been required to purchase the newer devices whenever contracting to do a drilling job which requires a rig capable of accomplishing the dual functions.

It is these problems in the art which the invention of the present application is designed to overcome. The invention provides a structure which facilitates conversion of the older, conventional, bottom-hole drilling rigs into rigs which can serve the dual functions of operating the drill bit and driving the casing down around the drill rod.

BRIEF SUMMARY OF THE INVENTION

The present invention is a conversion apparatus for converting bottom-hole drilling rigs to top-of-the-hole rigs which can simultaneously accomplish hole drilling and driving of casing which is inserted in the hole around the drill rod to serve as a retainer for supporting the inner wall of the hole. It is used to convert a bottom-hole drilling rig of the type which includes a ram for applying linear force in a desired direction, a percussion assembly mounted to the ram for movement in the desired direction and rotation about an axis extending in that direction, and a bit element having an anvil portion insertable in a receptacle formed axially in the percussion assembly. The bit element is of a construction so that, when it is inserted in the receptacle, a piston, also mounted within the receptacle, can be activated in reciprocating axial movement so that the piston strikes the anvil portion of the bit. The bit further includes an abrasive portion for cutting extending outside the receptacle. As previously mentioned, the ram also imparts rotational motion to the percussion assembly, and such motion is, in turn, transmitted to the bit so that the abrasive portion thereof may effect drilling. The invention of the present application includes a first adapter which can be connected to the percussion assembly in place of the bit element. This first adapter is configured to transmit the linear force of the ram and percussive force created by the piston in its reciprocating axial movement to the casing to be driven. The invention also includes a second adapter, attached to the first adapter, which transmits the ram's linear force, the percussive force of the piston, and the rotational motion of the percussion assembly to the drill rod.

The first adapter can comprise a mandrel which has a male portion structured similarly to the anvil portion of the bit element. The male portion of the mandrel includes an anvil surface which, when the mandrel is inserted in the percussion assembly in place of the bit, is positioned to receive percussive strokes of the piston. It can also include axially extending keyways for receipt of keys formed in the inner surface of the receptacle. By use of such a construction, the rotational motion of the percussion assembly can be transmitted to the mandrel. The mandrel can also include a hammer portion for transmitting the linear pressure of the ram and the percussive force of the piston to the casing.

The second adapter can be configured as a coupling threaded at both of two ends. At one end of the coupling, it can be attached to the hammer portion of the mandrel. At its other end, the coupling can be attached to the drill rod. The rigid connection so formed effects transfer of the linear force, the percussive force, and the rotational movement of the percussion assembly to the drill rod.

The conversion apparatus of the present invention can, thus, provide a drilling rig which can utilize components of existing rigs, serve additional functions, and, thereby, maximize efficiency of operation. The rig thus provided includes a percussion assembly which, in bottom-hole drilling rigs, has a drill bit directly received therein and is mounted at the end of the drill rod for the direct application of percussion strokes to the bit anvil down in the hole. In the improved rig, the percussion assembly is mounted directly to the ram and is retained above the ground. The bit is, however, replaced with the mandrel. A male portion of the mandrel can be configured the same as a corresponding male portion of the bit. The male portion of the mandrel can include an anvil for insertion within the receptacle of the percussion assembly such that a piston activated in reciprocating motion within the receptacle can apply percussive strokes to the anvil. The percussion assembly, therefore, causes both linear pressure applied to the percussion assembly by the ram and percussive force of the piston to be applied to the mandrel. Additionally, rotational motion imparted to the assembly by the ram is transferred to the mandrel by appropriate means such as a key pattern formed in the inner wall of the receptacle and a corresponding keyway pattern formed in the mandrel.

All three of these forces are translated to a drill rod rigidly coupled to the mandrel. The drill rod extends down the hole and has the bit abrasive portion mounted at the bottom end thereof to accomplish the drilling function.

The mandrel can further include a hammer portion. The downward pressure of the ram and the percussive force of the reciprocating piston are applied to a casing encircling the drill rod by this hammer portion. The rig, thereby, effects simultaneously the drilling and case driving functions.

As will be seen by one of skill in the art, the rotational motion imparted to the mandrel will not be conveyed to the casing. It is not, however, either necessary or desirable that the casing rotate as it is being driven into the hole.

In certain embodiments in which the mandrel is slidably mounted within the percussion assembly receptacle for movement between a first position in which the piston is activated to percussively reciprocate against the anvil and a second position in which the piston is deactivated and the anvil portion of the mandrel is spaced from the piston, the rig can include means for limiting withdrawal of the mandrel from the receptacle beyond a second defined position. This limiting means can include at least one chain retained at a carrier assembly which supports the hammer portion of the mandrel against axial movement beyond the second position. The chain extends axially to a point fixed relative to the percussive assembly, at which point the second end of the chain is maintained. This can be accomplished by attaching it to structure fixedly attached either to the carrier assembly or a drive chain which conveys force from a prime mover to the ram. The chain will be extended to its full length and taut as the downward pressure applied to the ram is abated and the drill rod and bit are withdrawn from the hole. When the chain is extended to its full length, the mandrel will be in its second position in which the percussive strokes of the piston are not applied to the anvil portion of the mandrel.

When pressure is applied to the ram and resistance at the bottom of the hole to the bit is transmitted to the mandrel to move it axially into the receptacle in its first position, the piston is caused to reciprocate against the anvil. In this first position of the mandrel, the limiting chain will be slack.

The invention of this application is thus an apparatus for converting a bottom hole drilling rig to a top-of-the-hole rig which can simultaneously effect drilling and casing driving. The specific advantages of the invention will become apparent with reference to the accompanying drawings, detailed description of the invention, and claims.

BRIEF DESCRIPTION OF THE DRAWINGS

FIG. 1 is a view in perspective of a drilling rig in accordance with the invention of the present application;

FIG. 2 is a fragmentary view of the rig of FIG. 1 showing the mandrel in a first position with respect to the percussion assembly;

FIG. 3 is a view similar to that of FIG. 2 showing the mandrel in a second position;

FIG. 5 is an exploded view in perspective of a mandrel and coupling for connecting drill rod to the mandrel;

DETAILED DESCRIPTION OF THE INVENTION

Figures 4, 6, 8:
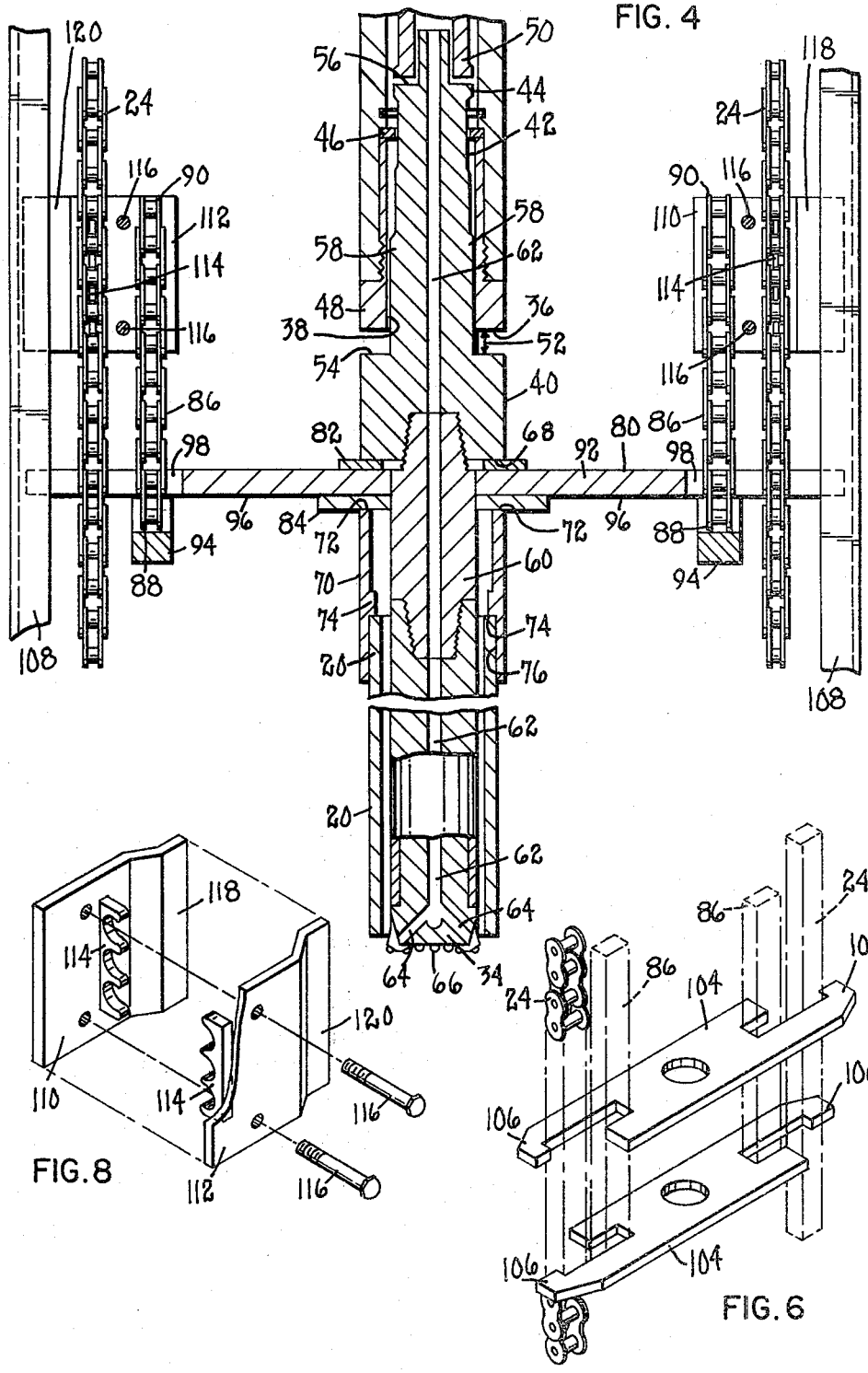
FIG. 4 is a fragmentary side sectional view, some parts broken away.
FIG. 6 is an exploded view in perspective of one embodiment of a carrier plate in accordance with the invention of this application.
FIG. 8 is an exploded view in perspective of apparatus for attaching the carrier chains to ram tensioning chains.
Figure 9:
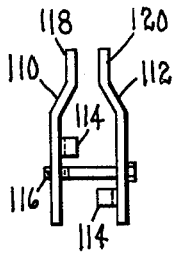
FIG. 9 is a bottom plan view of the apparatus of FIG. 8.
Figure 7:
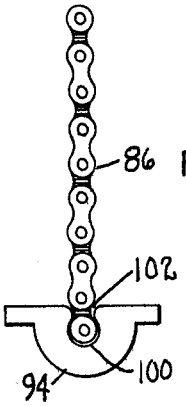
FIG. 7 is a side elevational view illustrating one method of attaching flexible carrier chains to the carrier plate.

Referring now to the drawings wherein like reference numerals denote like elements throughout the several views, FIG. 1 shows a drilling rig 10 in accordance with the invention of the present application. The rig 10 includes a frame having supports 12 on which the body 14 of the rig 10 is mounted. The frame may mount the rig to a movable vehicle or fixedly with respect to the ground. An operator is shown at an operator station 16 having controls 18 for governing various functions of the rig 10.

FIG. 1 shows a segment of casing 20 partially driven into the ground by the rig 10. The operator is shown in the process of withdrawing a segment of drill rod 22 from the hole already drilled. Also illustrated in the Figure are a pair of tensioning chains 24 mounted to sprockets 26 best illustrated in FIGS. 2 and 3. The shafts 28 of the sprockets 26 mount the chains for reciprocal movement in a desired direction. The chains are driven by hydraulic or other suitable means known in the art.

To the chains 24 is fixedly mounted a ram 30 so that, as downward movement is applied to the chains 34, the ram 30 is carried downward thereby. The operator of the rig 10 can, by controlling the chain driving means, impose a linear downward pressure upon the ram 30.

The ram 30 transfers the linear force to a percussion assembly 32 extending downward therefrom. It also imparts rotational motion to the percussion assembly 32 so that a bit element 34 disposed at the bottom of drill rod 22 extending from the percussion assembly 32 will effect the drilling function.

Apparatus heretofore identified is known in the art. For the sake of brevity, therefore, its detailed operation will not be described herein.

Referring then to FIG. 4, the percussion assembly 32 has a first axial end 36. Formed in the first axial end 36 is a receptacle 38 from which, in rigs known in the art, a bit element 34 is suspended. FIG. 4, however, illustrates a mandrel 40 in accordance with the present invention substituted for the bit element 34. The mandrel 40 includes a male portion 42, or anvil portion, which extends within the receptacle 38. The male portion 42 of the mandrel 40 is structured similar to that of the bit element which is normally used with the percussion assembly 32 for a bottom-hole mode of rig operation. The male portion 42 of the mandrel 40 includes an annular lip 44 which, when the bit is used, seats on a retaining ring 46 as the bit is withdrawn by the ram 48. Since the present invention uses other means, which will be hereinafter described, to preclude withdrawal of the mandrel 40 from the receptacle 38, the lip 44 of the mandrel 40 will not necessarily rest on the retaining ring 46.

Mounted within the receptacle 38 of the percussion assembly 32 for reciprocating axial movement is a piston 50. In FIG. 4, the mandrel 40 is in a second position with respect to the percussion assembly 32 as illustrated by the gap 52 between a shoulder 54 formed in the mandrel 40 and the first axial end 36 of the assembly. In this position, the piston 50 is not activated and the anvil surface 56 of the mandrel 40 is spaced axially from the piston 50. During drilling operations, however, the force imparted by the bottom of the hole to a drilling surface of the bit 34 is transmitted upward to the mandrel 40 to close the gap 52 between the mandrel shoulder 54 and the percussion assembly 32. In this first position, the anvil surface 56 of the mandrel 40 is closed up to the piston 50 and a pneumatic fluid such as high pressure air is directed to actuate the piston 50 in its reciprocating movement.

In addition to the linear down pressure imparted to the ram 30 by the tensioning chains 24 and the percussive force of the piston 50 upon the anvil 56 of the mandrel 40, the percussion assembly 32 further causes the mandrel 40 to rotate about a longitudinal axis of the assembly. As seen in FIG. 5, the mandrel 40 has formed in an outer cylindrical surface a series of splines or keyways 58. A similar arrangement formed in the female inner surface of the percussion assembly receptacle 38 mesh with the spline 58 so that, as the assembly 32 is made to rotate, such rotative movement is translated to the mandrel 40.

The continuous downward tension of the ram 30, the percussive force of the piston 50 upon the mandrel 40, and the rotational movement imparted to the mandrel 40 by the percussion assembly 32 are all transmitted downward to the drill rod 22 and the bit assembly 34 by a rigid connection 60 between the mandrel 40 and the drill rod 22. This rigid coupling 60 is shown in both FIGS. 4 and 5. Application of these three forces to the drill bit effect efficient drilling.

As seen in FIG. 4, a channel 62 is formed longitudinally through the mandrel 40, the coupling 60, and the drill rod 22. Segments of the channel 62 in each of these elements are aligned to form a continuous channel from the piston 50 to the drill bit 22. When the mandrel 40 is in its second position, high pressure air normally used to activate the reciprocating movement of the piston 50 can be directed downward through this channel 62 to exit through ports 64 formed in the bit proximate the abrasive surface 66. The high pressure air so directed can be used to entrain cuttings therein and to blow them up and out of the hole.

The downward ram pressure and percussive force generated by the reciprocating piston 50 can be further utilized to drive casing 20 which is used to retain the inner wall of the hole. A hammer portion 68 of the mandrel 40 can be made to transmit these forces either directly to the casing 20 or by using an adaptor or adaptors for receiving these forces from the hammer portion 68 of the mandrel 40 and, in turn, transferring them to the casing 20. One consideration which might bear on whether or not an adaptor is used is the size of casing 20 to be driven. If it has an inner diameter larger than the outer diameter of the hammer portion of the mandrel 40, an adaptor must be used to extend radially the area of the mandrel hammer 68 so that the casing 20 can be engaged.

The mandrel hammer portion 68 illustrated in FIG. 4 has an area large enough to enable engagement of the casing 20, but other factors must also be considered. FIG. 4 shows a discharge collar 70 disposed axially between the mandrel 40 and the casing 20. The collar 70 has a first shoulder 72 to which the down pressure and percussive force can be applied and a second shoulder 74 for axially engaging the casing 20 and, thereby, transmitting these forces to the casing 20. As shown in FIG. 4, the second shoulder 74 is annular and formed on the inner surface 76 of the collar 70. The collar 70 has an inside diameter approximating the outside diameter of the casing 20. A discharge conduit 78, shown in FIGS. 2 and 3, extends from the collar 70 between the shoulders 72, 74 thereof.

By utilizing a collar 70 of this nature, when the high pressure air which can be used to actuate the piston 50 is directed downward through the drill rod 22 to the bit area to blow cuttings out of the hole, the cuttings entrained in air flow will exit through this discharge conduit 78.

As shown in FIGS. 2 and 3, the collar 70 can include a series of alignment vanes 79 mounted on its outer surface. As the collar 70 is lowered onto the casing 20, the vanes 79 can serve to direct the casing 20 to a coaxial relationship with the collar 70 as they approach one another. In one embodiment, the collar 70 can include three vanes 79 spaced from one another about the outer surface of the collar 70 at 120°.

In addition to the discharge collar 70, FIG. 4 also shows in axial alignment with the mandrel 40 and casing 20 a carrier assembly which includes a carrier plate 80, whose function will be hereinafter defined, a wear plate 82, and a protector plate 84 to insulate the carrier plate 80 from the resistance of the first shoulder 72 of the discharge collar 70. The protector plate 84 can be manufactured from a material particularly resistant to the effects of such impact. It serves to protect the larger and more expensive to manufacture carrier plate 80. Because of its smaller size, if signs of fatigue are observed in the protector plate 84 after a period of use, it can be discarded and replaced by a new one.

The wear plate 82 shown mounted on top of the carrier plate 80 serves a function similar to the protector plate 84. It absorbs not only the force of the downward pressure imposed by the ram 30 and the percussive force of the piston 50, but it also minimizes the effects of abrasive friction caused by the rotation of the mandrel 40 with repect to the non-rotating carrier plate 80. As with the protector plate 84, the wear plate 82 can be replaced after deteriorating.

One function which the carrier assembly serves is to axially transmit the downward pressure applied by the ram 30 and the percussive force of the piston 50 from the mandrel 40 to the casing 20. It serves an additional important function, however. As previously described with respect to drilling rig configurations known in the art wherein a bit is received directly within the percussive assembly 32 rather than the mandrel 40 of the present invention, when the percussion assembly 32 is withdrawn from the hole the bit will slide to a second position with annular lip 44 seated on retaining ring 46 so that the bit will not slide out of the percussion assembly 32. When, however, a rig is configured in accordance with the invention of the present application, a significant amount of additional weight is carried by the mandrel 40 as compared to the limited weight of a bit. As hereinbefore described, the drill rod 22, which may include any number of lengths, with a bit element supported at the end thereof and the coupling 60 connecting the drill rod 22 to the mandrel 40 are also suspended from the percussion assembly 32. It has been found that this additional weight frequently causes the annular lip 44 of the anvil portion 42 of the mandrel 40 to deform and slide through the retaining ring 46.

By utilizing a carrier plate 80 axially supporting the hammer portion 68 of the mandrel 40, the weight of the drilling elements can be taken off the annular lip 44. Flexible means can be used to limit retraction of the mandrel 40 from the receptacle 88 of the percussion assembly 32 beyond the second position of the mandrel 40. As shown in FIG. 4, this flexible means can take the form of a pair of carrier chains 86 manufactured from chain material of a similar weight and strength to the ram tensioning chains 24. The chains 86 can be attached at first ends 88 to the carrier plate 80 and extends in a direction axially toward the percussion assembly 32 to loci fixed relative to that assembly. Second ends 90 of chains 86 can be retained at such loci in a number of ways. One appropriate method will be described hereinafter.

By being held at points fixed relative to the carrier assembly, the carrier chains 86 will be withdrawn in a direction away from the drilled hole as the percussion assembly 32 is so withdrawn. The carrier plate 80 and the mandrel 40 will also be withdrawn.

FIG. 4 shows one embodiment of a carrier plate 80 in which the plate is a single laminar element 92. The chains 86 can be attached by bolting or welding a U-bracket 94 to the bottom 96 of the carrier plate 80 beneath a hole 98 formed in the plate 80 through which the chains 86 may pass. Since the chain links can be structured so that, viewed from the side, they approximate figure eights, the U-bracket 94 can be structured with the bottom portion 100 of the U wider than the neck 102. By so configuring the U-bracket 94, a link of chain can be inserted in the bracket and will not be able to be withdrawn through the neck 102 thereof. Once the bracket 94 is attached to the underside 96 of the carrier plate 80, the chain 86 will not be able to be removed from the plate 80.

FIG. 6 shows a second embodiment of a carrier plate which can be used. That carrier plate is a double lamina 104 structure wherein, at one end of the plate, a single finger 106 extends in one direction to cooperate with a similar single finger of the second lamina, the second finger extending in an opposite direction to form a track rider which can ride along brace 108 of the rig body 14. By using a track riding structure of this nature, the pressure applied to the drill rod 22 can be maintained working substantially in the desired direction without deviation therefrom.

As seen in FIGS. 4 and 6, with either embodiment of the carrier plate, the plate 80 would obstruct the tensioning chains 24 if allowance were not made therefor. Thus, the carrier plate 80 includes an aperture formed therethrough to accommodate the tensioning chains 24.

FIGS. 2, 3, 4, 8, and 9 illustrates one method by which the second ends 90 of the carrier chains 86 can be maintained at fixed positions relative to the percussion assembly 32. Since movement of the percussion assembly 32 is directly tied to movement of the ram 30 and, in turn, movement of the tensioning chains 24, the chains 86 can be attached to the tensioning chains 24 at points along their lengths so that when the chains 86 are extended to their full lengths, the mandrel 40 is maintained in its second position. An assembly which can be used to mount the flexible means chains to the tensioning chains as shown in FIG. 8 includes two cooperating elements 110, 112 having spaced rows of teeth 114 for engagement of one of each set of chains 24, 86. Both sets of teeth 114 may be formed in one of the elements or, as in FIG. 8, one set of teeth may be formed in each of the elements. The elements can be brought together with the teeth engaging the chains and then attached together using suitable means such as bolts 116.

The cooperating elements may further include tabs 118, 120 which together form a track riding structure by which riding along brace 108 of the main body 14 of the rig 10 may be accomplished.

Numerous characteristics and advantages of my invention have been set forth in the foregoing description. It will be understood, however, that this disclosure is, in many respects, only illustrative, and changes may be made in details, particularly in matters of shape, size, and arrangement of parts. The scope of the invention is defined in the language in which the appended claims are expressed.

What is claimed is:

1. Apparatus for converting a bottom-hole percussion drilling rig of the type including a ram adapted to apply linear force in a desired direction to a length of drill rod extending from said ram in said direction, a percussion assembly attached to said drill rod at an end opposite the end at which said drill rod extends from said ram and having a receptacle open and extending axially in the direction in which the linear force is applied, to which assembly the linear force and rotational movement about the axis with respect to which the receptacle extends are applied by said drill rod, a piston mounted within the receptacle for reciprocating axial movement, and a bit element normally disposed within the receptacle so that the piston can percussively engage an anvil portion of the element, to a top-of-the-hole rig wherein said percussion assembly is mounted to said rig proximate said ram with said receptacle open and extending axially in the direction in which said ram applies linear force, and wherein said drill rod extends generally from said percussion assembly with said bit element attached to said drill rod at an end opposite an end by which said rod extends generally from said percussion assembly, which rig can simultaneously effect hole drilling and driving of casing, enclosing said drill rod, for retaining the inner surface of the hole, comprising:

first means configured to be operatively connected to the percussion assembly and disposed within said receptacle in place of said bit element for transmitting percussive force generated by the reciprocating axial movement of the piston and the linear force of the ram to an axial end of the casing; and second means attached to said first means for transmitting said percussive force, the linear force of the ram, and the rotational movement to the drill rod.

2. Apparatus for converting a bottom-hole percussion drilling rig of the type including a ram to which linear force in a desired direction is applied to a length of drill rod extending from said ram in said direction by a tensioning chain arrangement, a percussion assembly attached to said drill rod at an end opposite the end at which said drill rod extends from said ram and having a receptacle open and extending axially in the direction in which the linear force is applied, to which assembly the linear force and rotational movement about the axis with respect to which the receptacle extends are applied by said drill rod, a piston mounted within the receptacle for reciprocating axial movement, and a bit element normally disposed within the receptacle for axial movement between a first position at which the piston can percussively engage an anvil portion of the element and a second position, to a top-of-the-hole rig wherein said percussion assembly is mounted to said rig proximate said ram with said receptacle open and extending axially in the direction in which said ram applies linear force, and wherein said drill rod extends generally from said percussion assembly with said bit element attached to said drill rod at an end opposite an end by which said rod extends generally from said percussion assembly, which rig can simultaneously affect hole drilling and driving of casing, comprising:

mandrel means configured to be operatively connected to the percussion assembly and disposed within said receptacle in place of said bit element for axial movement between first and second positions corresponding to the first and second positions which the bit element can occupy when said rig is configured as a bottom-hole rig, said mandrel means including an anvil portion which is percussively engaged by the piston when said mandrel means is in said first position, and a hammer portion disposed to transmit percussive force generated by the reciprocating axial movement of the piston and the linear force of the ram to an axial end of the casing;

means attached to said hammer portion for transmitting the percussive force, the linear force of the ram, and the rotational movement to the drill rod; and means for limiting axial movement of said mandrel means away from said first position beyond said second position.

3. The apparatus of claim 2 wherein said transmitting means comprises a coupling having opposite ends, one of said ends configured to be attached at said hammer portion of said mandrel means and said other opposite end being configured to be attached at the drill rod, said coupling rigidly connecting said hammer portion to the drill rod.

4. The apparatus of claim 2 wherein said limiting means comprises:

a carrier assembly having a first side axially engaging said hammer portion of said mandrel; and flexible means having first and second ends, said first end affixed at said carrier assembly and said second end affixed at locations fixed relative to the percussion assembly.

5. The apparatus of claim 4 wherein said flexible means has an axial length, and wherein said means extends to its full axial length when said mandrel means is in said second position.

6. The apparatus of claim 5 wherein said flexible means comprises a pair of parallel chains, one of said pair extending on either side of said mandrel means and parallel to the receptacle axis.

7. The apparatus of claim 6 wherein each of said parallel chains has a second end and wherein said second ends are attached at the chains of the tensioning arrangement.

8. Apparatus for converting a bottom-hole percussion drilling rig of the type including a ram adapted to apply linear force in a desired direction to a length of drill rod extending from said ram in said direction, a percussion assembly attached to said drill rod at an end opposite the end at which said drill rod extends from said ram and having a receptacle open and extending axially in the direction in which the linear force is applied, to which assembly the linear force and rotational movement about the axis with respect to which the receptacle extends are applied by said drill rod, a piston mounted within the receptacle for reciprocating axial movement, and a bit element normally disposed within the receptacle for axial movement between a first position at which the piston can percussively engage an anvil portion of the element and a second position, to a top-of-the-hole rig wherein said percussion assembly is mounted to said rig proximate said ram with said receptacle open and extending axially in the direction in which said ram applies linear force, and wherein said drill rod extends generally from said percussion assembly with said bit element attached to said drill rod at an end opposite an end by which said rod extends generally from said percussion assembly, which rig can simultaneously effect hole drilling and driving of casing for retaining the inner surface of the hole, comprising:

a mandrel disposed within the percussion assembly receptacle in place of said bit element for axial movement between first and second positions corresponding to the first and second positions which the bit element can occupy when said rig is configured as a bottom-hole rig, said mandrel including a shoulder axially engaging the percussion assembly when said mandrel is in said first position, an anvil portion which is percussively engaged by the piston when said mandrel is in said first position, and a hammer portion;

a coupling rigidly connecting said hammer portion to the drill rod;

a carrier assembly having a first side axially engaging said hammer portion of said mandrel and a second side transmitting percussive force generated by the reciprocating axial movement of the piston and linear force of the ram to the casing; and flexible means having first and second ends, said first end affixed at said carrier assembly and said second end affixed at locations fixed relative to the percussion assembly, said flexible means being extended to its full length when said mandrel is in said second position.

9. The apparatus of claim 8 further comprising a discharge collar disposed axially between said second side of said carrier assembly and the casing, said discharge collar having a first shoulder axially engaged by said second side of said carrier assembly and a second shoulder axially engaging an end of said casing.

10. The apparatus of claim 9 wherein said collar has discharge means formed therein intermediate said shoulders.

11. A drilling rig for imparting rotational movement, linear force, and cyclical percussive force to an elongated drill element, and for imparting the linear force and the cyclical percussive force to casing encircling the drill element substantially along the length thereof, comprising:

a percussion assembly having a first axial end with a receptacle formed axially therein, and a piston disposed within said receptacle for reciprocating axial movement;

means for imparting rotational movement about an axis with respect to which said receptacle extends and linear force in the direction of said first axial end to said percussion assembly; and means for conveying said rotational movement, said linear force, and percussive force created by said reciprocating movement of said piston to the drill element and for conveying said linear force and said percussive force to the casing;

wherein said conveying means comprises:

(a) mandrel means operatively received within said receptacle and having a shoulder for axial engagement of said first axial end of said assembly, an anvil portion disposed within said assembly for cyclical percussive engagement by said piston, and a hammer portion for conveying said linear force and said percussive force to the casing; and (b) a coupling rigidly connecting said mandrel means to the drill element to convey said rotational movement, said linear force, and said percussive force thereto.

12. The rig of claim 11 wherein said mandrel means is movable between a first axial position at which said piston can percussively engage said anvil portion and a second axial position at which said anvil portion is axially spaced from said piston.

13. The rig of claim 12 wherein said conveying means further comprises a discharge collar disposed axially between said mandrel means and the casing, said collar having a first shoulder to which is applied said linear force and said percussive force and a second shoulder axially engaging an end of said casing, and wherein said collar has discharge means formed therein intermediate said shoulders.

* * * * *